United States Patent [19]

Johnson et al.

[11] 4,046,981

[45] Sept. 6, 1977

[54] KEYBOARD SWITCH WITH PRINTED WIRING BOARD STRUCTURE AND ITS METHOD OF MANUFACTURE

[75] Inventors: Dudley Bruce Johnson, Irving; Stephen Leroy Hanni, Richardson, both of Tex.

[73] Assignee: Texas Instruments Incorporated, Dallas, Tex.

[21] Appl. No.: 644,206

[22] Filed: Dec. 24, 1975

[51] Int. Cl.[2] ..... H01H 13/70; H01H 9/00

[52] U.S. Cl. ..... 200/159 B; 200/5 A; 200/275; 200/292; 200/302

[58] Field of Search ..... 200/5 R, 5 A, 159 B, 200/275, 302, 292

[56] References Cited

U.S. PATENT DOCUMENTS

| | | | |
|---|---|---|---|
| 2,262,777 | 11/1941 | Roper | 200/159 B |
| 3,133,170 | 5/1964 | Nanninga | 200/159 B X |
| 3,684,842 | 8/1972 | Boulanger | 200/159 B X |
| 3,749,859 | 7/1973 | Webb et al. | 200/159 B X |
| 3,796,843 | 3/1974 | Durkee et al. | 200/159 B X |
| 3,800,104 | 3/1974 | Lien et al. | 200/67 DA X |
| 3,806,673 | 4/1974 | Boulanger | 200/159 B X |
| 3,934,334 | 1/1976 | Hanni | 174/68.5 X |
| 3,952,174 | 4/1976 | Boulanger et al. | 200/159 B X |
| 3,967,084 | 6/1976 | Pounds | 200/159 B X |
| 3,973,091 | 8/1976 | Kaminski | 200/5 A |

*Primary Examiner*—James R. Scott

*Attorney, Agent, or Firm*—Hal Levine; Rene E. Grossman; Richard P. Berg

[57] ABSTRACT

A printed wiring board comprised of a plurality of keys or switches, which form a keyboard, for entry of data or changing the function of an electrical circuit. Each key comprises a flexible conductive actuating element and at least two conductive contacts which are affixed in a nonplanar relationship to the substrate of a printed wiring board. The actuating element is caused to come in contact with the conductive contacts when the actuating element is depressed, thus closing the switch.

19 Claims, 12 Drawing Figures

Figure 1:
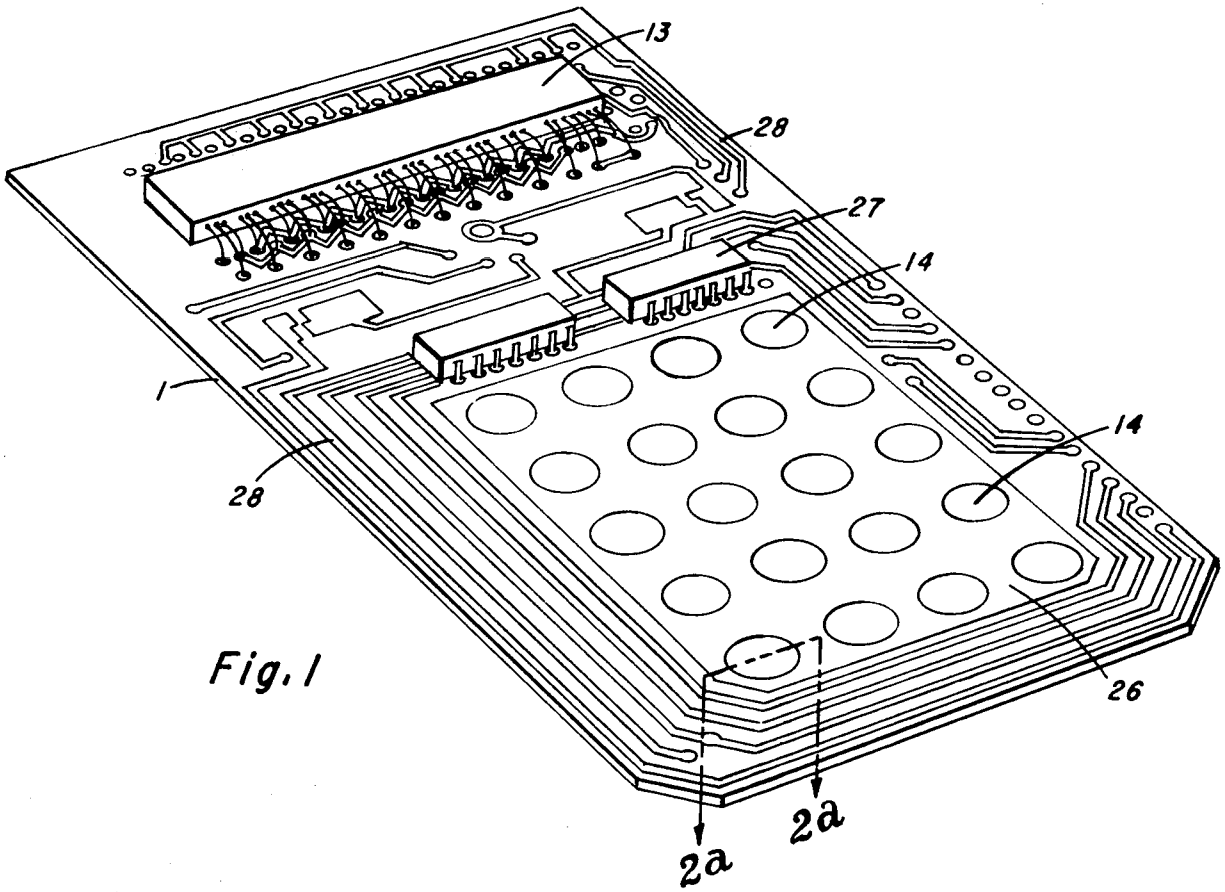

Fig. 2a
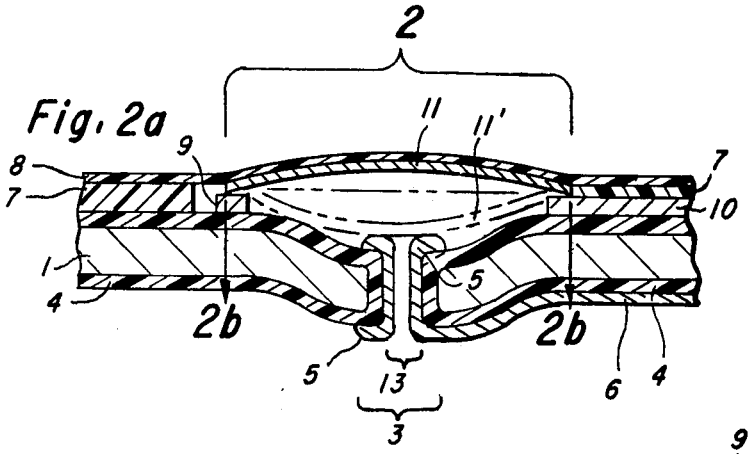
Fig. 2b
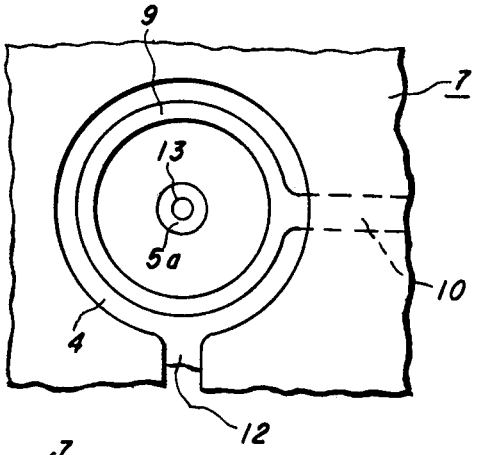
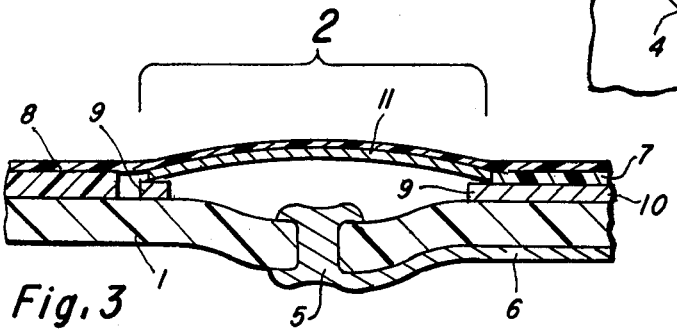
Fig. 3
Fig. 4
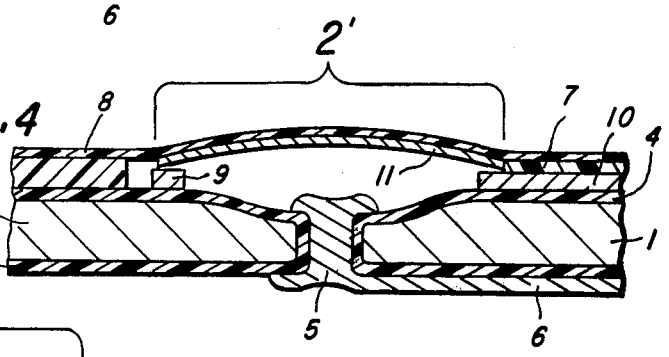
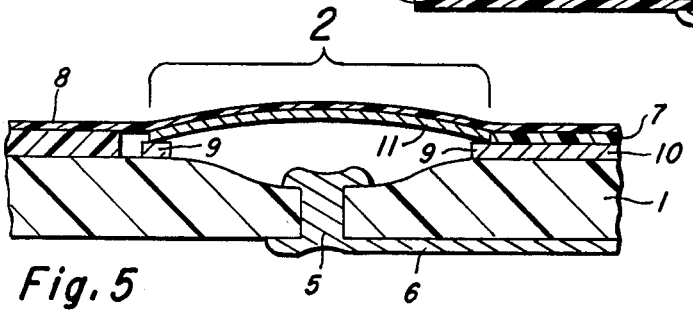
Fig. 5

KEYBOARD SWITCH WITH PRINTED WIRING BOARD STRUCTURE AND ITS METHOD OF MANUFACTURE

This invention relates to keyboard switches and, more particularly, to keyboard switches with printed wiring board structure and to methods of their manufacture. As is well known to those skilled in the art, printed wiring boards have been utilized in virtually every segment of the electronics industry because of increased reliability and decreased cost and size compared to hand-wired techniques. The substrate used with these printed wiring boards has been typically a nonductile plastic composition material. The manufacturing process used with these plastic substrate boards has basically been subtractive in nature. That is, a plastic board is coated on one or both sides with a conductive material, such as copper. It is then masked in those areas where conductors are desired with a material which resists a subsequent chemical etching which removes the copper from those areas where conductors are not desired.

Nonplastic substrate printed wiring boards are also known in the prior art. The process used with these boards, such as metal substrate boards, has been conversely additive in nature. Methods of manufacturing metal substrate boards are disclosed in U.S. Pat. Nos. 3,558,411; 3,745,095; and U.S. patent application Ser. No. 461,072, filed Apr. 4, 1974.

A prior art key or switch with a printed wiring board structure is disclosed in U.S. Pat. No. 3,806,673. When operating a key on a keyboard, an electrically conductive actuating element, which is a flexible and typically curved disc shaped membrane, is mounted in such a manner as to permit the center of the actuating element to travel beyond a plane defined by the perimeter of the actuating element before closing an electrical circuit controlled by the key in order to convey to the person operating the key a feeling or sensation that the electrical circuit has been completed. This feeling or sensation is a "click" imparted to the operator's fingers; this "click" is a highly desirable feature because it lets the operator know the data has been entered into the electronic circit associated with the key without the necessity of observing output devices connected to the electrical circuit. The existing art actuating element mounted on a printed wiring board manufactured according to the subtractive process can impart this desirable "click" to the operator if the metallic conductors affixed to the plastic substrate are relatively thick. Thus, the existing art actuating element has been mounted on a board having metallic conductors of approximately 5 mils thickness.

This prior art key design relies on the use of relatively thick conductors to raise the perimeter of the actuating element approximately 5 mils above the level of the substrate permitting generation of the desirable "click." This design is unsuitable for use with a printed wiring board manufactured according to additive technology because in excess of 50 hours of conductor plating time would be required to build up conductors of 5 mil thickness, thus substantially increasing the cost of a keyboard.

Briefly, in accordance with the key herein described, relatively thin conductors can be utilized and the desirable "click" feature is retained. Generally, the actuating element is disposed over a depressed region in the major surface of the printed wiring board. At least one lower contact is located in the depressed region. An upper contact is located in spaced relation to the lower contact and closer to the major surface. The actuating element has at least one surface of conductive material which contacts the upper contact and which will contact the lower contact or contacts when the actuating element is depressed. Since upper and lower contacts need not be thick conductors, the required plating time compared to the prior art key is substantially reduced.

It is one object of this invention to improve keyboards installed on printed wiring boards.

It is yet another object of this invention to provide a printed wiring board with a keyboard well suited for being manufactured according to additive technology.

It is yet another object of this invention to provide an improved keyboard in which a "click" is imparted to the finger of the operator when a key is depressed.

It is still another object of this invention to provide a method of manufacturing a metal substrate printed wiring board equipped with a keyboard.

In accordance with one feature of this invention, a keyboard is incorporated into a printed wiring board manufactured according to additive technology which imparts a "click" to the finger of the operator when a key is depressed.

In accordance with another feature of this invention, a metal substrate keyboard is manufactured with a keyboard integrally installed thereon.

These and other objects and features of the invention will be evident from the following detailed description and claims with reference to the drawings in which:

FIG. 1 is a perspective view of a printed wiring board embodying the present invention;

FIG. 2*a* is a sectional side view of a key illustrated in FIG. 1;

FIG. 2*b* is a sectional top view of the key illustrated in FIG. 2*a;*

Figure 6A:
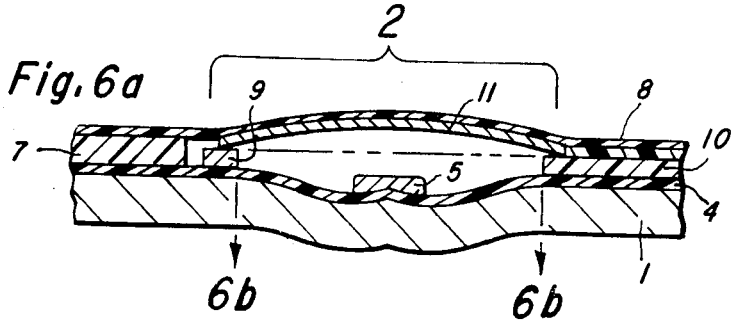
Figure 6B:
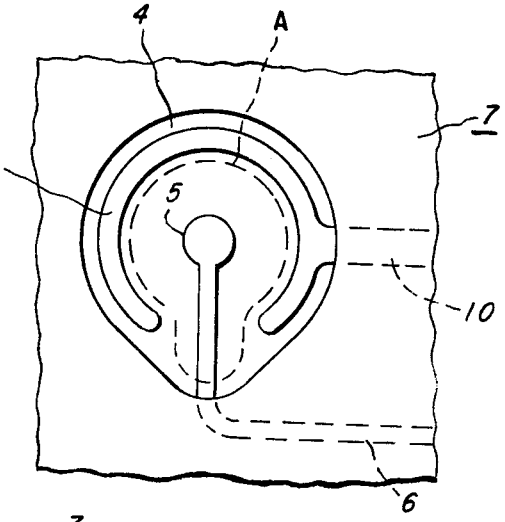

FIGS. 3, 4, 5 and 6*a* are sectional side views depicting various embodiments of a key illustrated in FIG. 1;

FIG. 6*b* is a sectional top view of the key illustrated in FIG. 6*a;*

Figure 7:
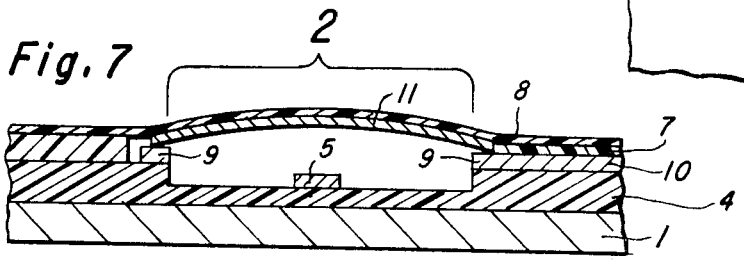
Figure 9:
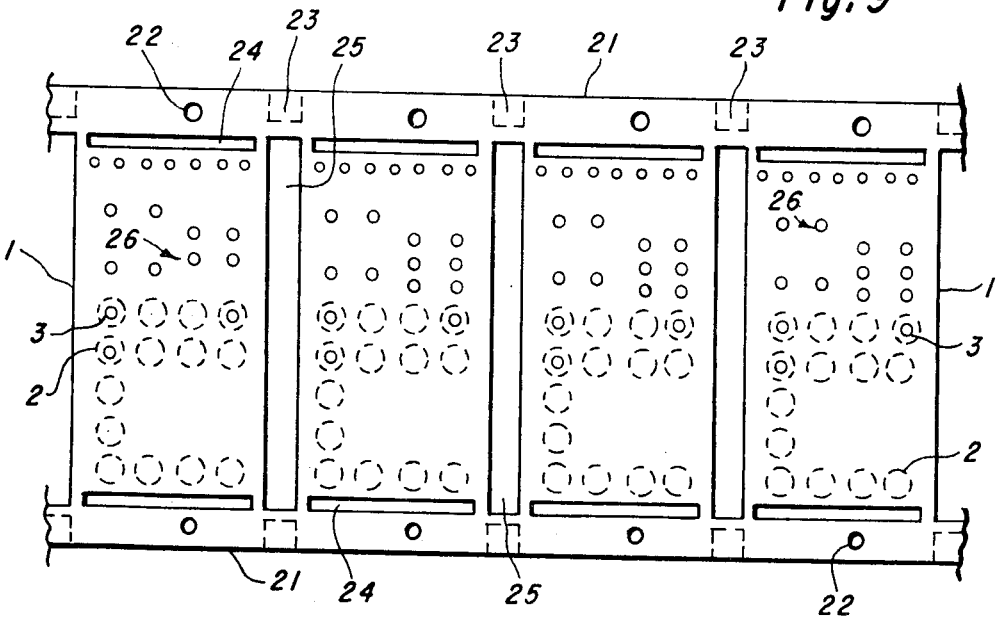
Figure 8A:
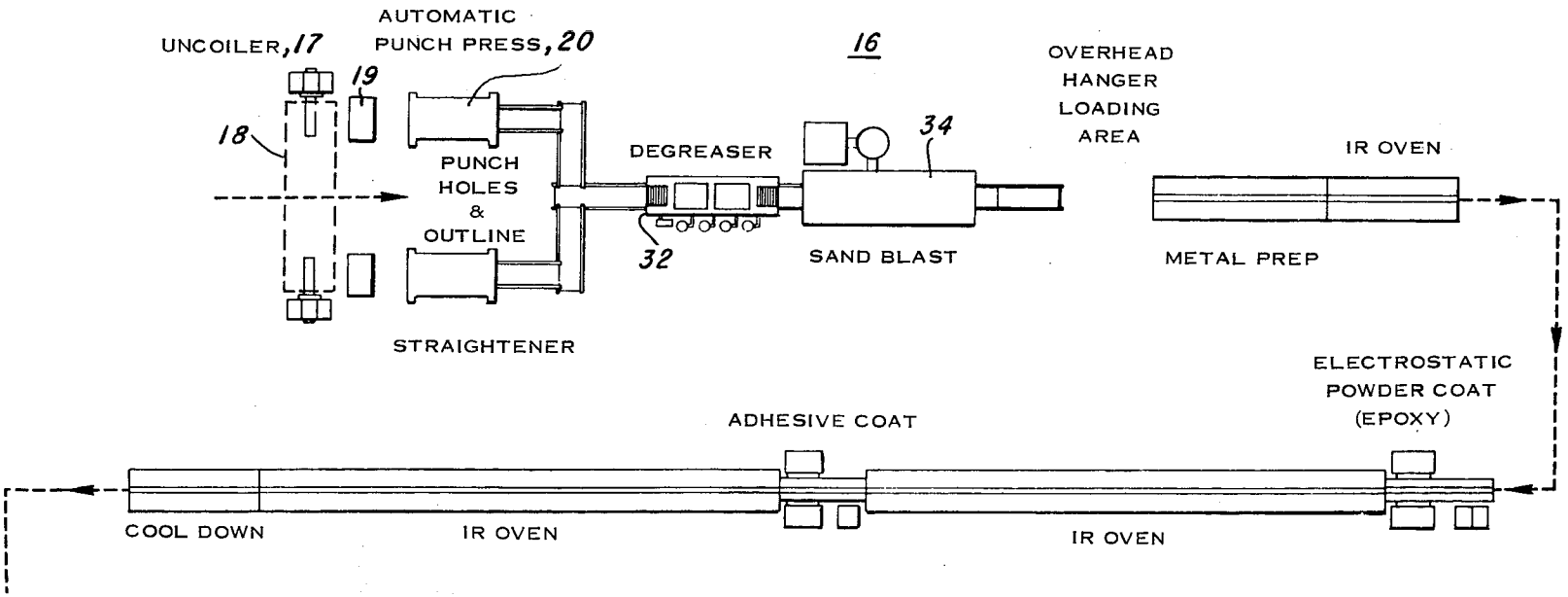
Figure 8B:
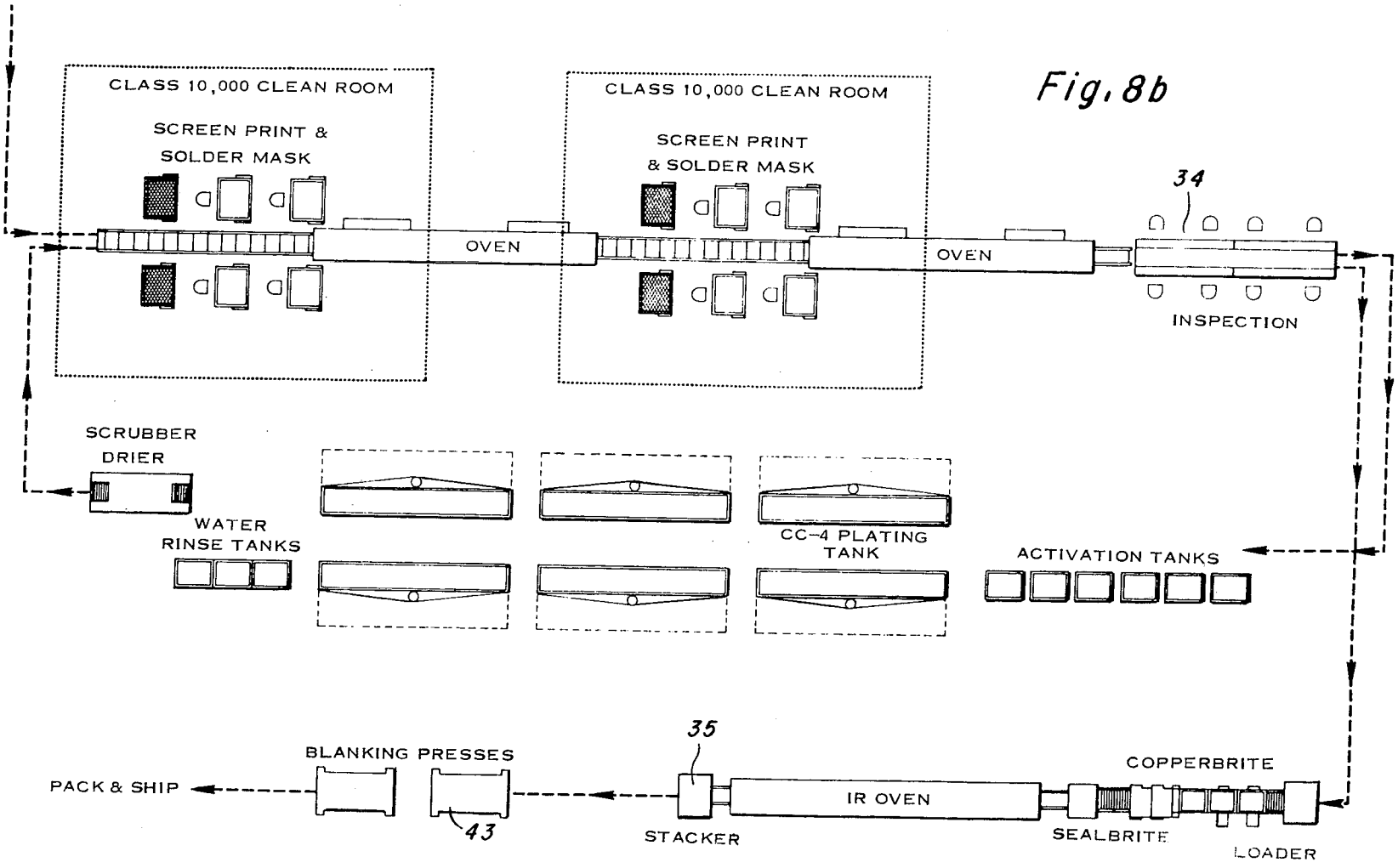

FIG. 7 is a sectional side view of another embodiment of a key illustrated in FIG. 1;

FIGS. 8*a* and 8*b* are block diagrams of an assembly line for manufacturing printed wiring board keyboards in accordance with the disclosed method; and FIG. 9 is a fragmentary view of the lead frame and metal substrates for the printed wiring board keyboard as blanked and dimpled in the sheet metal.

Referring now to FIG. 1, an assembly embodying the present invention is shown which includes a substrate 1, keys 14 mounted on the substrate to form a keyboard, an integrated circuit 27 and display devices 13 mounted on the substrate 1. Conductors 28 interconnecting the keys 14, the integrated circuit 27 and display devices 13 are shown on the substrate 1. A solder mask 26 covers the desired areas. By adding a switch, batteries, interconnecting wires and a case with key pushbuttons (not shown) to the above described assembly, a hand-held electronic calculator results.

Now referring to FIGS. 2*a* and 2*b*, there is shown in FIG. 2*a* a sectional side view of a key 14 located on a printed wiring board, and there is shown in FIG. 2*b* a sectional top view as indicated in FIG. 2*a*. A substrate 1 is shown with an indentation which creates a depressed region 2. A small hole 3 is located in substrate 1 in the area of the depressed region 2. A substrate insulating layer 4, which is typically utilized if a conducting substrate 1 is also utilized, covers the substrate 1. A lower contact 5 is affixed to insulating layer 4 and at least partially fills small hole 3 with conductive material and forms a small protuberance 5*a* of conductive material toward the lower part of the depressed region 2. A lower conductor 6 affixed to insulating layer 4 connects lower contact 5 with other contacts or circuit components (not shown). Lower condutor 6 is located on the opposite side of the substrate 1 from the depressed region 2.

An upper contact 9 is affixed to insulating layer 4, is disposed radially outwardly of the geometric center of the depressed region 2 and higher than lower contact 5, and provides the surface upon which actuating element 11 rests. Actuating element 11 is disposed over the depressed region 2 and makes electrical contact with upper contact 9. A conductor 10, which is also affixed to insulating layer 4, interconnects upper contact 9 with other contacts and circuit components (not shown). An optional protecting layer 7 may be provided over the conductor 10 and insulating layer 4. A retaining film 8 is disposed over the actuating element 11 and the optional protecting layer 7 (or over conductors 10 and insulating layer 4 if the protecting layer 7 is not used), thus maintaining the position of the actuating element 11 over the depressed region 2.

The key 14 is operated by depressing retaining film 8 in way of actuating element 11 causing actuating element 11 to deflect and make electrical contact with lower contact 5 thus closing the circuit between conductors 6 and 10. Actuating element 11 is shown in a depressed position as dotted line 11'. To permit trapped air to escape from the key when depressed, a duct 12 in the protecting layer 7, or alternatively a small air escape passage 13 through the lower contact 5, should be provided. If ten or more keys 14 are utilized, the ducts 12 may be interconnected and the keyboard environmentally sealed because the combined volume of ten keys 14 is sufficient to permit a single key 14 to be depressed with little additional effort.

Alternate embodiments of the invention are depicted in FIGS. 3–7. Referring now to FIG. 3, there is shown a Key 14, the structure and operation of which is similar to the key depicted in FIGS. 2*a* and 2*b* and hereinbefore described except that the insulating layer 4 has been eliminated and the various conductors 6 and 10 and contacts 5 and 9 are attached directly to the substrate.

Yet another embodiment is depicted in FIG. 4, where the structure and operation of the key is similar to the key depicted in FIGS. 2*a* and 2*b* and hereinbefore described except that, instead of having an indentation in the board creating a depressed region 2 on one side of the board and a protuberance on the opposite side of the board, there is shown a depressed region 2' on one side of the board without a corresponding protuberance on the opposite of the substrate 1. Still another embodiment is depicted in FIG. 5, which is similar to the embodiment shown in FIG. 4, but lacking an insulating layer on the substrate 1.

Referring now to FIGS. 6*a* and 6*b*, there is shown in FIG. 6*a* a sectional side view through a key 14 located on a printed wiring board and there is shown in FIG. 6*b* a sectional top view as indicated in FIG. 6*a*. The structure and operation of this key is similar to the key depicted in FIGS. 2*a* and 2*b* and hereinbefore described except that the conductors 6 and 10 are located on the same side of the substrate 1 as the depressed region 2 lower contact 5 is disposed on a small protuberance or projection disposed in depressed region 2, and the hole 3 has been eliminated. As is shown in FIG. 6*b* by a dashed line, Reference A, depressed region 2 must be appropriately shaped to assure that the conductor 6 connecting the lower conductor 5 does not make electrical contact with actuating element 11.

Still another embodiment is shown in FIG. 7 where the structure and operation of the key 14 is similar to the key depicted in FIGS. 2*a* and 2*b* and hereinbefore described, except that the substrate 1 has no depressed region 2 and thus may be a nonductile material and, in order to dispose the upper contact 9 above the lower contact 5, the upper contact 9 is affixed to a thicker layer of insulation 4 than is lower contact 5. The embodiment depicted in FIG. 7 is adaptable for use with printed wiring boards manufactured in part by the subtractive process if lower contact 5 and its conductor 6 were attached directly to the substrate 1 and the upper contact 9 and its condutor 10 were affixed to an insulating layer 4.

Referring now to FIGS. 8*a* and 8*b*, in FIG. 8*a* there is shown a mass production assembly or fabrication line 16 beginning with an uncoiler 17 for a coil of sheet metal 18 which may be, for example, a coil of commercial quality cold rolled sheet steel, copper or aluminum or an alloy thereof about 10–100 mils thick but preferably 18–25 mils thick which will become the metal substrate 1. The coil of sheet metal is initially fed into a metal straightener 19 which may be of a roller type. Thereafter, the rollers of the metal straightener 19 pull the sheet metal from the uncoiler 17. After straightening, the sheet metal passes into an automatic punch press 20 for forming a plurality of metal substrates 1 (FIG. 9) between a lead frame 21. The automatic punch press 20 dimples or coins depressed regions 2 and blanks: the holes 3, sprocket holes 22 and spacer tabs 23 in the lead frame 21; horizontal slits 24 which separate the metal substrates 1 from the lead frame 21 and longitudinal slits 25 which separate the metal substrates one from another; and a desired pattern of holes 26, in each of the metal substrates 1. Depressed regions 2 are formed by a tool (not shown), for example, of 1.0 to 0.25 but preferably 0.5 to 0.325 inch diameter and having either a rounded or flat head which is pressed against the metal substrate during the above discussed dimpling or coining operations with sufficient force to form a depressed region 2, the base of which is displaced, for example, 2 to 15 mils, but preferably 3 to 5 mils from the surface of the substrate 1. Using a rounded head tool to dimple the substrates 1 is preferred since it has been found to be a more easily controllable process than coining with a flat-headed tool. A nonsymmetrical tool must be used if substrates 1 will have conductors formed on only one surface, as can be seen by the nonsymmetrical shape of the depressed region 2 (Reference A on FIG. 6*b*) in this embodiment.

The board is then deposited with insulation 4, an adhesive (not shown), conductors 6, 10 and 28 and contacts 5 and 9. It has been found that utilizing the method and materials described in U.S. Pat. No. 3,934,334 yields satisfactory results; while various thicknesses of insulation and conductors can be utilized, it has been found that insulation 4 having a thickness of at least approximately 3 mils, but preferably 4 to 6 mils, yields satisfactory results and conductors having a thickness of at least approximately 0.3 mils, but preferably 1 mil, yields satisfactory results. Referring to FIG. 1, copper conductors 28 are thus deposited to interconnect various components: the display devices 13, at least one integrated circuit 27 and the keys 14. After the copper is deposited, nickel-boron or nickel and gold may be deposited over the contacts 5 and 9 (FIGS. 2–7) to inhibit galling of the contacts 5 and 9 during key 14 operation. Processes for plating nickel, nickel-boron nd gold are well known to those trained in the art.

Referring to FIG. 8*b*, after the board has been deposited with conductive material, it is then processed to remove excess plating products from the metal circuitry. A solder mask is screened on to cover all areas not to be soldered, except that the depressed regions 2, contacts 5 and 9 and ducts 12, if any, are also not covered by the solder mask. It has been found that removal of excess plating products and application of the solder mask according to the method and materials disclosed U.S. Pat. No. 3,934,334 yields satisfactory results. The solder masked printed wiring boards are then inspected by the inspection apparatus 34, recoiled and placed in a loader 35, or passed through a blanking press 43 to cut out the printed wiring boards one from another and from the lead main frame for packing and shipping to an assembly area (not shown).

The coiled sheet of printed wiring boards or the stacked printed wiring boards are shipped to an assembly area on a supporting pallet. The pallet and coil or stacked boards are covered with a heat shrink plastic for protection. At the assembly area, the coiled or printed wiring boards are unwound onto an automatic system which utilizes the lead frame as an index picture and a spacer tabs as assembly stands. At the assembly line, all other active components are assembled onto the printed wiring boards and their leads are inserted into holes of the printed wiring board. The leads are electrically coupled to the printed wiring boards, preferably by wave soldering techniques, being careful not to allow the solder or flux to come in contact with the unmasked key contacts. For wave soldering, the board is foam or wave coated in areas which will subsequently be soldered with a suitable flux such as, for example, that sold under the trademark Alpha No. 711 Flux. The boards are then preheated to 170°–210° F in a preheat oven and wave soldered at 3–5 feet per minute on a flowing stream of solder pumped through an orifice at 480° F. Contact time with the wave is 5–10 seconds. Wave soldering and cleaning can be done while using the lead frame as a material handling device.

After wave soldering the actuating elements 11 are positioned over the various key 14 depressed regions 2 and a retaining film 8 such as an adhesive-backed film sold under the trademark Mylar by Dupont is laid down with the adherent side towards the actuating elements 11 and solder mask 7 to retain the actuating elements 11 in place and, if desired, to environmentally seal a plurality of keys 14 including interconnecting ducts 12. An actuating element 11 which has been found to be satisfactory is a stainless steel disc having a 1.0 to 0.25, but preferably 0.5 to 0.325 inch diameter and having a center displaced from the plane defined by the disc perimeter 5 to 20, but preferably 8 to 15 mils.

In another embodiment of the method for manufacturing the keyboards, the coining or dimpling step may be eliminated and the depressed region 2 formed instead by selectively screening on additional insulating material to a 2 to 15 mil, but preferably 3 to 5 mil, thickness in areas immediately adjacent to where the depressed regions 2 are desired to be located or, alternatively, selectively screening on additional adhesive to a 2 to 15 mil, but preferably 3 to 5 mil thickness in such areas. If additional insulating material is screened on, adhesive should be applied before and after the screening of the additional insulating material. The adhesive and insulating materials and method of application described in U.S. Pat. No. 3,934,334 yields satisfactory results.

In still another embodiment of the method for manufacturing the keyboards, the coining or dimpling step may be eliminated and the depressed region 2' (FIGS. 4 and 5) formed in the metal substrate instead by mechanically or chemically removing metal material at desired locations or by electron discharge milling at desired locations. Mechanical, chemical and electron discharge machining or milling are well known in the art.

Now again referring to FIG. 1, the number and loction of keys 14, integrated circuits 27, interconnecting conductors 28, solder mask 26 and display devices 13 is merely illustrative of how these features may be incorporated into a printed wiring board; it will be evident to one skilled in the art that other arrangements including using any number of keys, integrated circuits or display devices, or locating keys on both sides of the board, or incorporating a keyboard into other electronic apparatuses, such as telephones, credit card verifiers or the like, could be employed without departing from the principles and spirit of the invention.

Having described the invention in connection with certain specific embodiments thereof, it is to be understood that further modification may now suggest itself to those skilled in the art; for example, (a) the shape of the contacts 5 and 9, the depressed region 2 or 2' or the actuating element 11 may be varied; or (b) more than one lower contact 5 could be affixed in a single key. It is understood that the invention is not to be limited to the specific embodiments except as set forth in the appended claims.

What is claimed is:

1. A momentary contact switch comprising:

a. a metallic sheet substrate having at least one major surface of insulating material and having at least one indentation on said major surface;

b. at least one first contact disposed on said major surface in the region of said at least one indentation;

c. a second contact affixed to said substrate, being disposed in spaced relation to said at least one first contact, and having a top surface of said second contact located above a top surface of said at least one first contact; and d. an actuating element having at least one surface of conductive material, mounted on said second contact and being disposed over at least part of said indentation, the conductive surface of said actuating element being electrically connected to said second contact and in spaced relation to said first contact;

e. said first and second contacts being electrically connectable by the conductive surface of said actuating element to provide an electrically conductive path between said first and said second contacts in response to depression of said actuating element into said indentation.

2. A switch as defined in claim 1 wherein said indentation comprises an indentation on said major surface of said insulating material being disposed over a similar indentation on said metallic sheet.

3. A switch as defined in claim 1 wherein said indentation comprises a change in the thickness of said insulating material.

4. A switch as defined in claim 1 wherein said indentation comprises a circular indentation on said major surface of said substrate.

5. A switch as defined in claim 1 wherein said actuating element comprises a curved metallic disc.

6. A switch as defined in claim 1 wherein said substrate has two major surfaces of insulating material, said indentation occurring on a first major surface, and said switch further comprising a first conductor being disposed on said second major surface and circuit means electrically connecting said first contact and said first conductor.

7. A switch as defined in claim 6 wherein said circuit means comprises a body of conductive material extending through said substrate means between the first and second major surfaces thereof.

8. A switch as defined in claim 6 further comprising a second conductor being disposed on said first major surface and connected to said second contact.

9. A switch as defined in claim 1 wherein said indentation includes a protuberance of said substrate disposed at said at least one first contact.

10. A switch as defined in claim 1 further comprising retaining means for maintaining the location of said actuating element over said indentation said retaining means being affixed to said substrate outwardly of said indentation.

11. A switch as defined in claim 10 wherein said retaining means comprises a flexible film affixed to said actuating element and to said major surface.

12. A switch as defined in claim 1 wherein said second contact is crescent shaped.

13. A swtich as defined in claim 1 wherein said second contact has an annular shape.

14. A momentary contact switch comprising:

a. a metallic sheet having at least one major surface of insulating material and having at least one indentation on said major surface being disposed over a similar indentation on said metallic sheet;

b. at least one first contact disposed in said at least one indentation;

c. a second contact affixed to said insulating material, being disposed in spaced relation to said at least one first contact, and having a top surface of said second contact located above a top surface of said at least one first contact; and d. a metallic actuating element, mounted on said second contact and being disposed over at least part of said indentation and being electrically connected to said second contact and in spaced relation to said first contact;

e. said first and said second contacts being electrically connectable by said metallic actuating element to provide an electrically conductive path between said first and said second contacts in response to depression of said metallic actuating element.

15. The switch according to claim 14, wherein said metallic actuating element is concave-convex disc.

16. The switch according to claim 15, further comprising retaining means for maintaining the location of said actuating element over said indentation, said retaining means being affixed to said substrate outwardly of said indentation.

17. A momentary contact switch comprising:

a. a metallic sheet having at least one major surface of insulating material and having at least one indentation on said major surface;

b. at least one first contact disposed in said at least one indentation;

c. a second contact disposed on said insulating material in spaced relation to said at least one first contact, said second contact having a top surface disposed above a top surface of said at least one first contact; and d. a metallic actuating element disposed in contact with said second contact and disposed at least partially over said indentation, said at least one first contact and said second contact being electrically connected by said element in response to depression of said element.

18. The switch according to claim 17, wherein said metallic actuating element is a concave-convex disc.

19. The switch according to claim 18, further comprising retaining means for maintaining the location of said actuating element over said indentation, said retaining means being affixed to said substrate outwardly of said indentation.

* * * * *